US006814607B1

(12) United States Patent
Wentzel

(10) Patent No.: US 6,814,607 B1
(45) Date of Patent: Nov. 9, 2004

(54) APPARATUS AND METHOD FOR GUIDING AND ALIGNING CIRCUIT BOARD ASSEMBLIES TO A BACKPLANE

(75) Inventor: Robert Milton Wentzel, Elburn, IL (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 10/706,249

(22) Filed: Nov. 12, 2003

(51) Int. Cl.[7] ..... H01R 13/64
(52) U.S. Cl. ..... 439/377; 361/756; 361/801
(58) Field of Search ..... 439/377, 64, 374; 361/756, 801

(56) References Cited

U.S. PATENT DOCUMENTS 5,791,917 A * 8/1998 Eberhardt et al. ..... 439/79
6,147,485 A * 11/2000 Halliday et al. ..... 324/158.1
6,544,052 B1 * 4/2003 Schwartz ..... 439/152
6,551,138 B2 * 4/2003 Ruque ..... 439/607
6,597,581 B2 * 7/2003 Barringer et al. ..... 361/756
6,661,671 B1 * 12/2003 Franke et al. ..... 361/752

* cited by examiner

*Primary Examiner*—Gary Paumen

(57) ABSTRACT

A method and apparatus for supporting circuit board assemblies and for aligning and guiding plugs on the rear of said circuit board assemblies for insertion into mating sockets of a backplane. A vertically oriented guide plate has horizontal guide slots. Each circuit board assembly has a pair of guide posts that are inserted into a guide slot to support the circuit board assembly. The guide slot and the guide post maintain proper alignment of a plug on a rear extremity of said circuit board extremity with a backplane socket as the circuit board assembly is moved inwardly towards the backplane.

18 Claims, 9 Drawing Sheets

APPARATUS AND METHOD FOR GUIDING AND ALIGNING CIRCUIT BOARD ASSEMBLIES TO A BACKPLANE

FIELD OF INVENTION

This invention relates to apparatus and a method for guiding and aligning circuit board assemblies with sockets of a backplane. This invention further relates to a method and apparatus that supports circuit board assemblies of electronic apparatus and which also guides and aligns a plug on the circuit board assemblies with mating openings of sockets on a backplane.

PROBLEM

Electronic systems such as large computer systems and communications switching systems make extensive use of circuit board assemblies. These systems typically comprise a plurality of circuit board assemblies that must be electrically interconnected with each other. The mounting and interconnection of the plurality of circuit board assemblies is accomplished in the prior art by the provision of a frame having a plurality of horizontal shelves arranged in a bookshelf configuration with the circuit board assemblies being positioned vertically between grooves of vertically adjacent horizontal shelves. The vertical spacing between adjacent shelves is fixed and can only accommodate circuit board assemblies of a fixed height. The use of circuit board assemblies of different heights requires that circuit board assemblies of a larger height be positioned between a first pair of shelves having the required spacing, that circuit board assemblies of an intermediate height be positioned between a different pair of shelves having a spacing that accommodates the intermediate vertical height and that circuit board assemblies of a lesser height be positioned between another pair of shelves whose spacing accommodates the lesser height. A vertical backplane having sockets is positioned proximate the rear of the assembly of shelves. Sockets on the vertical backplane are adapted to interconnect with mating plugs on the circuit board assemblies mounted between the horizontal shelves.

The insertion of a circuit board assembly into a backplane socket requires that the circuit board assembly be positioned between the pair of shelves whose spacing is appropriate for the height of the circuit board assembly. Each circuit board assembly is positioned in the grooves of its pair of shelves and is then pushed towards the backplane until the pins on the rear of a plug of the circuit board assembly engage mated openings in a socket of the backplane. This operation that must be done with precision to avoid damaging the pins of the plug while inserting them into openings of the socket. Typically the circuit board assemblies are guided on their top and bottom edges by the grooves in the top and bottom of the shelves to align pins of the plug with mating openings in the backplane sockets. The sockets of the backplane are interconnected by printed wiring on the backplane so that the plurality of the circuit board assemblies are interconnected with each other in the manner required to define an operable system. The alignment of the circuit board assembly pins with the sockets on the backplane is a critical operation due to the small tolerance involved. Any misalignment of parts can result in damage that renders an expensive circuit board assembly and/or its backplane socket useless.

The arrangements of the prior art have the disadvantage that spacing between adjacent shelves is fixed and can accommodate only circuit board assemblies having the dimensions defined by the vertical spacing between each pair of shelves. This arrangement limits the flexibility of the mechanical implementation of the system since vertical shelf spacing for a new replacement circuit board assembly must often have dimensions identical to those of the circuit board assembly it replaces even though such dimensions might not be as advantageous as new technologies might permit.

It is therefore seen that the prior art arrangements of circuit board assemblies and the card cage structure including the alignment facilities is cumbersome and leads to unnecessary expense in the physical design of systems embodying circuit board assemblies.

SOLUTION

The above and other problems are solved in accordance with the present invention in accordance with which a method and apparatus is provided for guiding and aligning circuit board assemblies with mating with sockets mounted on a backplane of an electronic system. The apparatus embodying the present invention eliminates the horizontal shelves of the prior art arrangements. The elimination of the horizontal shelves is advantageous in that it overcomes the limitation that the circuit board assemblies must be grouped by sizes and inserted between pairs of shelves having the vertical spacing required to accommodate each different size.

In accordance with the method and apparatus of the present invention, the sockets into which sockets of circuit board assemblies are inserted are mounted in a pattern of horizontal rows and vertical columns on the backplane. A vertically oriented guide plate is positioned between a columns of sockets. Each vertical guide plate has horizontal guide slots that receive guide posts affixed to the vertical sides of a circuit board assembly. A circuit board assembly is supported by a guide plate by the steps of inserting guide posts on the circuit board assembly into a horizontal guide slot and by pushing the circuit board assembly inwardly toward the backplane until a plug at the rear of the circuit board assembly is proximate the backplane socket into which it is to be engaged. The rear surface of the plug has pins adapted to be inserted into corresponding openings in the sockets. The plug has ribs on each side which are adapted to mate with matching slots in the vertical sides of the socket that receives the plug.

The vertical guide plates and their horizontal guide slots perform the dual function of receiving and supporting a circuit board assembly as well as the function of guiding the plug on the rear of the circuit board assembly inward toward the socket into which it is to be inserted.

The guide slots and the guide posts on the circuit board assembly guide and align the circuit board assemblies as they are pushed inwardly until the rear portion of the plug begins to engage the socket into which the plug is to be inserted. At that time, a rear guide post of the circuit board assembly is within a rear guide hole formed in the guide plate at the rear extremity of the guide slot. The rear guide hole is substantially larger than the rear guide post of the circuit board assembly. This enables the rear portion of the circuit board assembly to move a limited amount vertically as well as horizontally with the front guide post acting as a pivot point for the motion of the rear of the circuit board assembly. This slight motion is desirable so that ribs on the vertical side walls of the plug at the rear of the circuit board assembly can mate with slots on the vertical side walls of the socket into which the plug is to be inserted. The circuit board assembly and its plug is fully inserted into its associated socket when the circuit board assembly is moved further inward so that the pins on the rear surface of the plug mate with corresponding openings in the socket.

The apparatus and method embodying the present invention eliminates the use of the library type horizontal shelving of prior art arrangements by using the vertical guide plates having horizontal guide slots to support the circuit board assemblies and to achieve accurate alignment and engagement with sockets on the backplane. The elimination of the horizontal shelving of the prior art equipment provides better air flow over the circuit board assembly for cooling because no alignment channel is obstructing the air flow. This provides better tolerance control for inserting the plug of the circuit board assembly with the backplane socket because the dimensions are-smaller and confined to single parts. This allows circuit board assemblies of the different heights to be guided into engagement with a socket by using the guide slots of the vertically oriented guide plates. This is further advantageous in that it provides potential for electromagnetic shields between adjacent circuit board assemblies of adjacent columns.

The apparatus and method embodying the present invention is further advantageous in that the rear openings at the rear extremity of the horizontal guide slots releases the circuit board assembly guiding function when the mating facilities of the sockets and associated guide pins on the plugs are engaged. This allows the plug and its socket to take over the guiding of the pins of the plug into openings of the socket. This also allows for the positioning of the alignment devices close to the circuit board connector fields to reduce the affect of board warpage. The apparatus and method of the present invention is further advantageous as it uses simple parts design and reduces the cost and complexities of the prior art card cage arrangements used to mount circuit wiring board assemblies and ensure their alignment with mating connector sockets of the backplane.

DESCRIPTION OF THE DRAWINGS

The above and other advantages and features of the invention may be better understood from a reading of the following detailed description thereof taken in conjunction with the drawings in which:

FIG. 5 also illustrates the guide posts engaged in a guide slot. FIG. 5 further illustrates the slots of a socket which mate with guide ribs on a plug. FIG. 5 also illustrates the position of the circuit board assembly at a location corresponding to the view of FIG. 3 in which the rear portion of the plug is beginning to engage its socket.

FIG. 6 also shows guide posts of the circuit board assembly and illustrates how the rear most guide post is within the confines of the rear guide hole.

DETAILED DESCRIPTION

Figure 1:
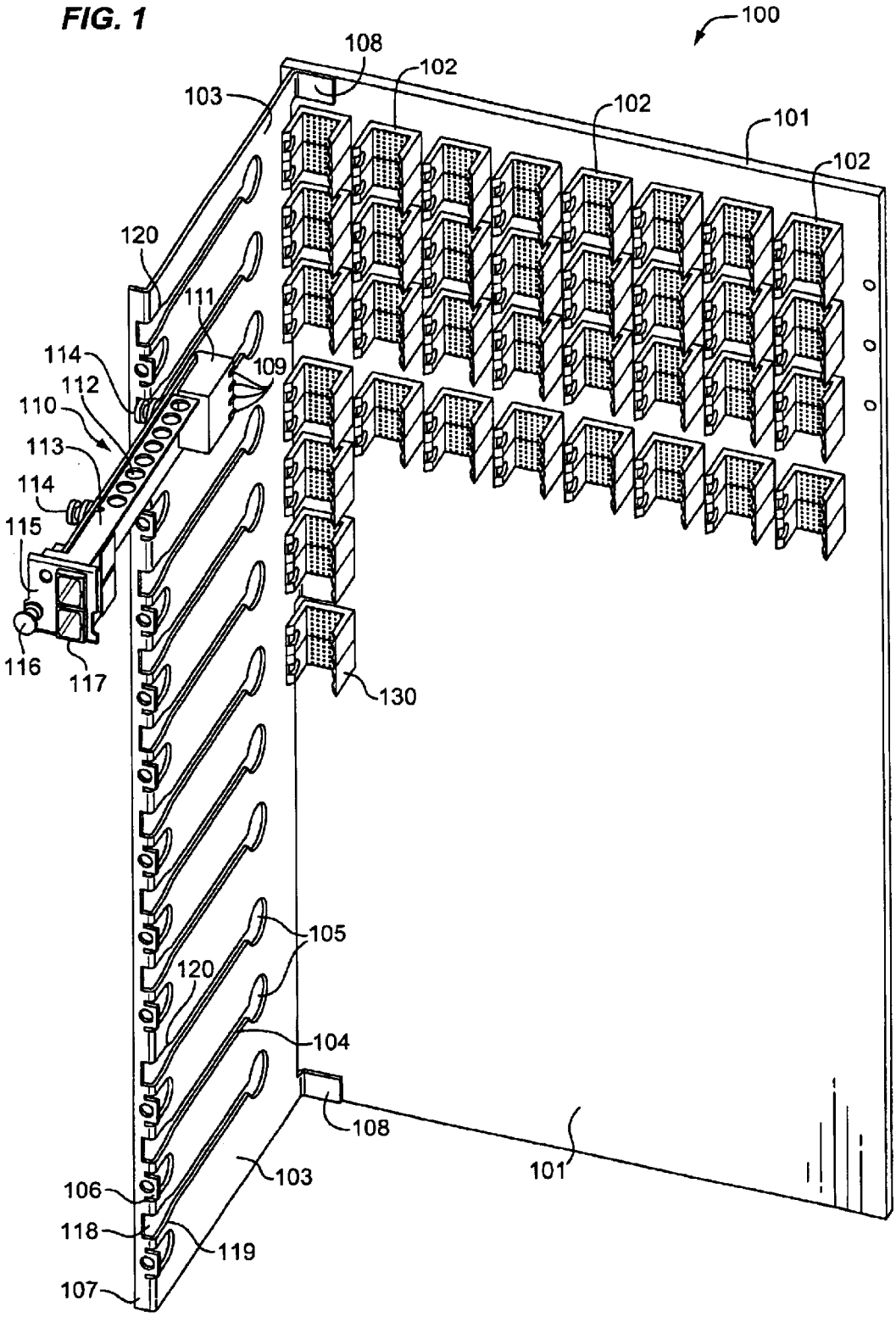
FIG. 1 illustrates the position a circuit board assembly when it is initially engaged with guide slots of a guide plate.

Description of FIG. 1

FIG. 1 discloses a first possible exemplary embodiment of the invention. A plurality of sockets 102 are arranged in a row and column alignment on backplane 101. Also affixed to backplane 101 is a guide plate 103 which is vertically aligned with respect to the left-most column of sockets 102. Guide plate 103 is affixed to backplane 101 by tabs 108. Guide plate 103 has a plurality of horizontal guide slots 104 each of which is unique to a different socket 102. Circuit board assembly 110 has a front surface 115, a plurality of openings 112 on an upper surface 113, a pull knob 116 and RJ45 jacks 117. The rear of the circuit board assembly 110 includes a plug 111 having a rear portion (not shown) that includes pins which are adapted for engagement with corresponding openings in the socket 102 into which plug 111 and its pins are to be inserted.

Circuit board assembly 110 has a front guide post 114 and rear guide post 114 affixed to its left side on FIG. 1. The rear guide post 114 is shown partially engaged with the front extremity of a guide slot 104. The front end portion of guide slots 104 has flared elements 119 and 120 to facilitate the insertion of guide posts 104.

Figure 2:
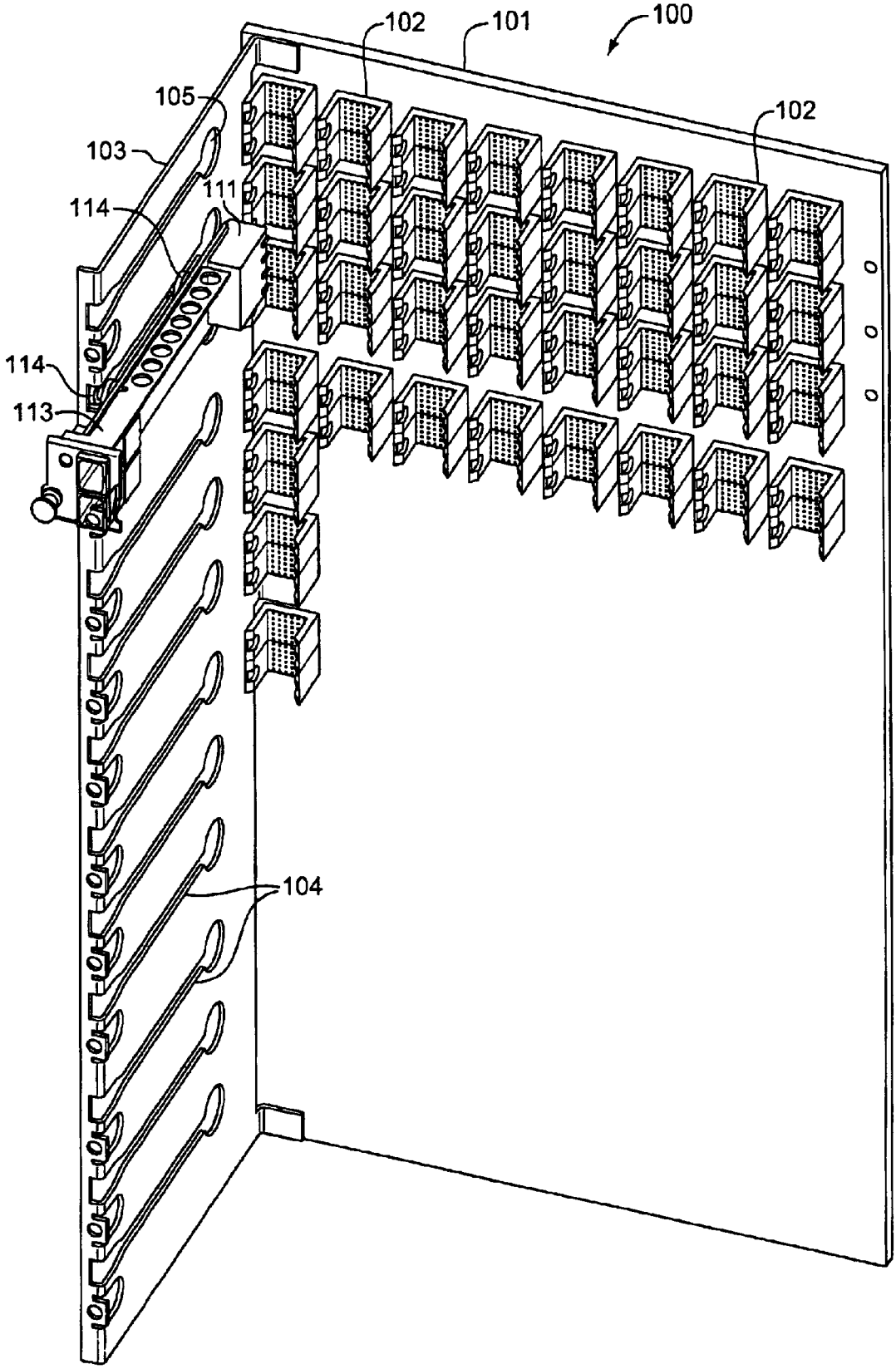
FIG. 2 is similar to FIG. 1 except that it illustrates the position of the circuit board assembly when it is further inserted into its associated guide slot.
Figure 3:
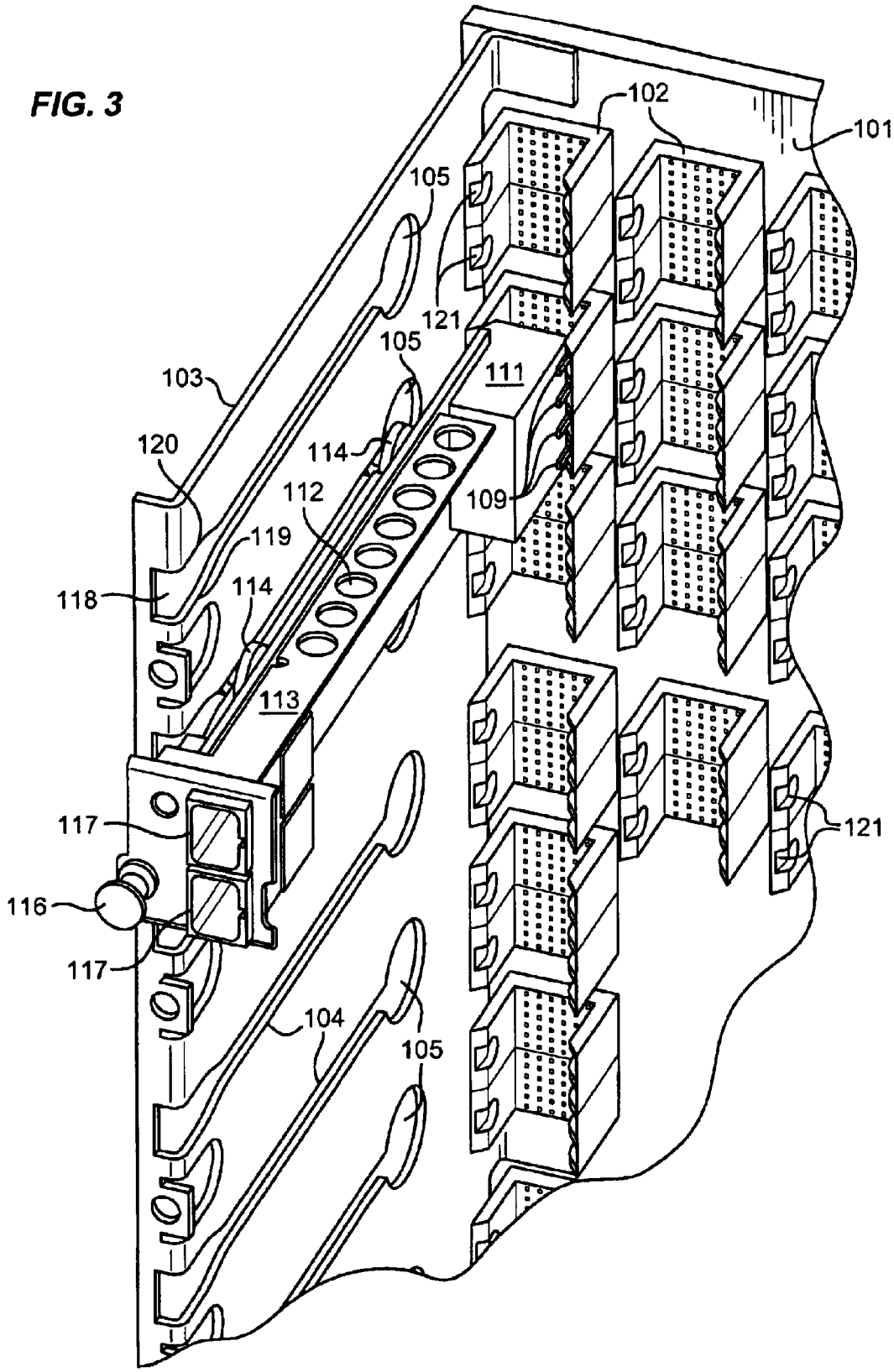
FIG. 3 illustrates the circuit board assembly when it is further inserted so that its plug is immediately proximate a socket into which the plug is to be inserted.
Figure 4:
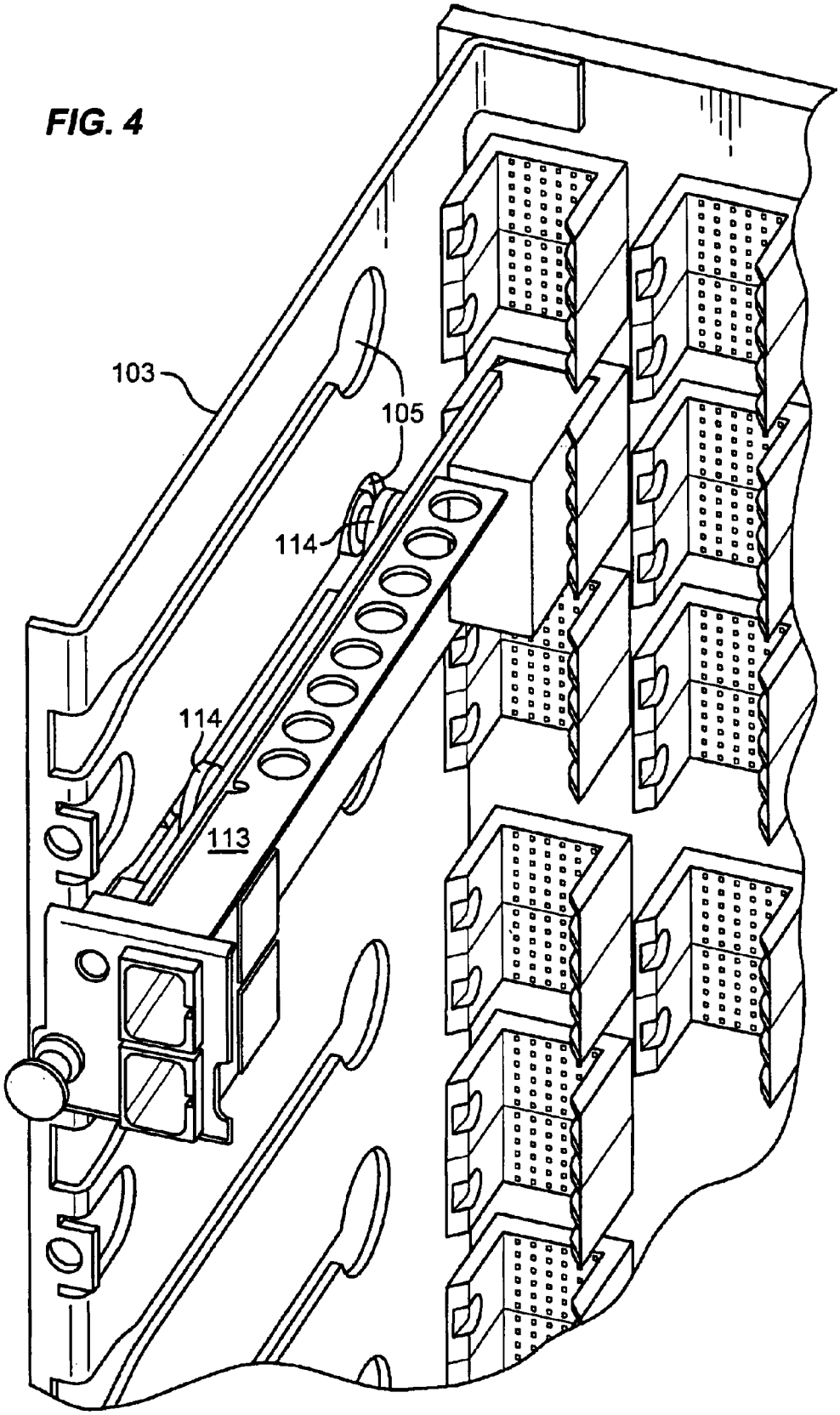
FIG. 4 shows the plug fully inserted into its socket.

The view of FIG. 2 is similar to that of FIG. 1 except that the circuit board assembly 110 is further inserted into its guide slot 104. On FIG. 2, both guide posts 114 are shown engaged with a guide slot 104. The view of FIG. 3 is similar to that of FIG. 2 except that the circuit board assembly 110 is further inserted into its guide slot 104 so that its rear guide post 114 is proximate hole 105 at the rear extremity of guide slot 104. Also, on FIG. 3, ribs 109 of plug 111 are proximate the walls of the socket 102 into which they are to be inserted. The view of FIG. 4 is similar to that of FIG. 3 except that the plug 111 is fully inserted into its socket 102. FIGS. 3 and 4 show slots 121 in the left wall of socket 102.

Figure 5:
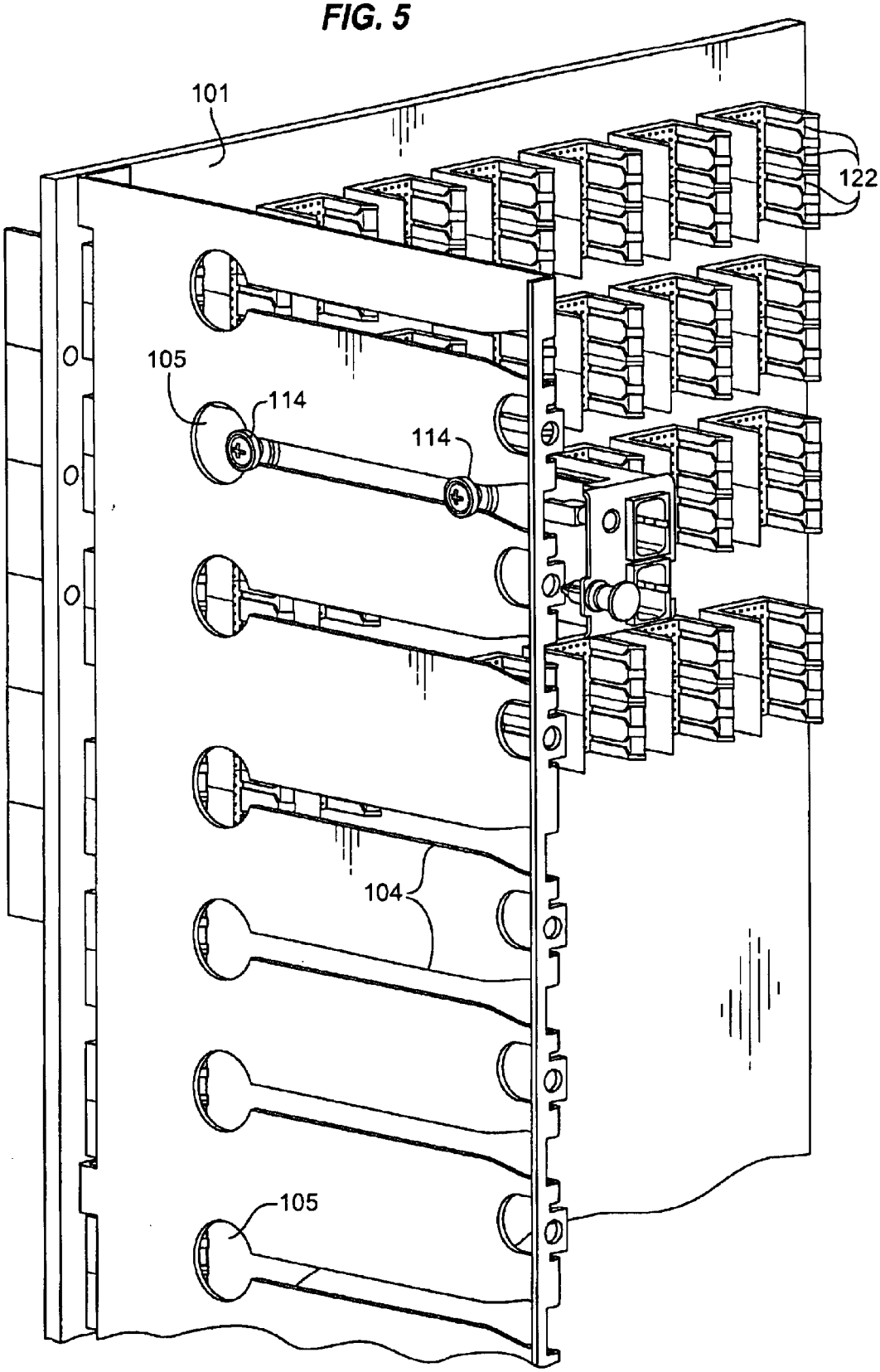
FIG. 5 is a left oblique view that shows the left side of a guide plate.
Figure 6:
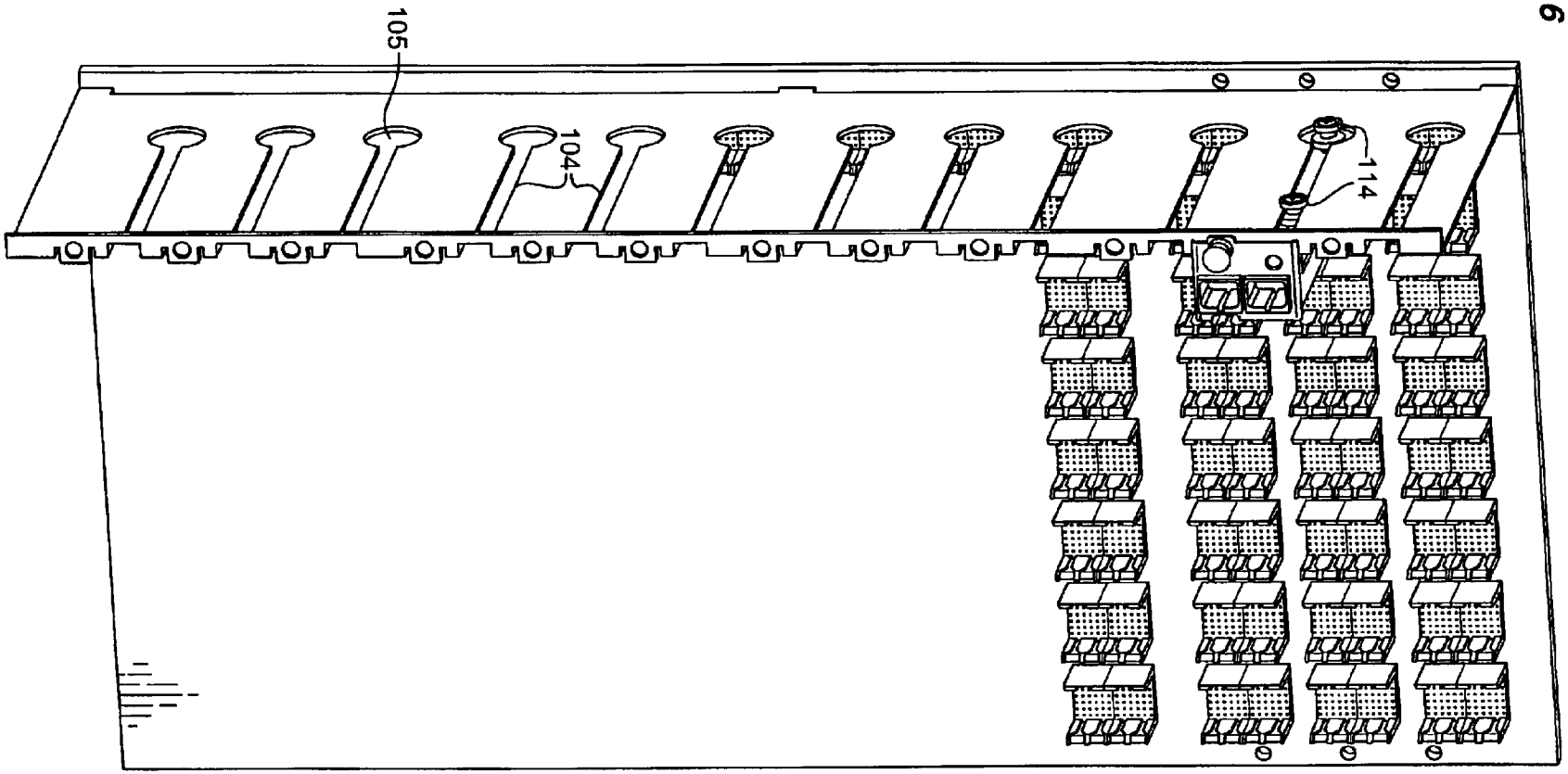
FIG. 6 is comparable to the view of FIG. 4 in which the plug is fully inserted into its socket.
Figure 7:
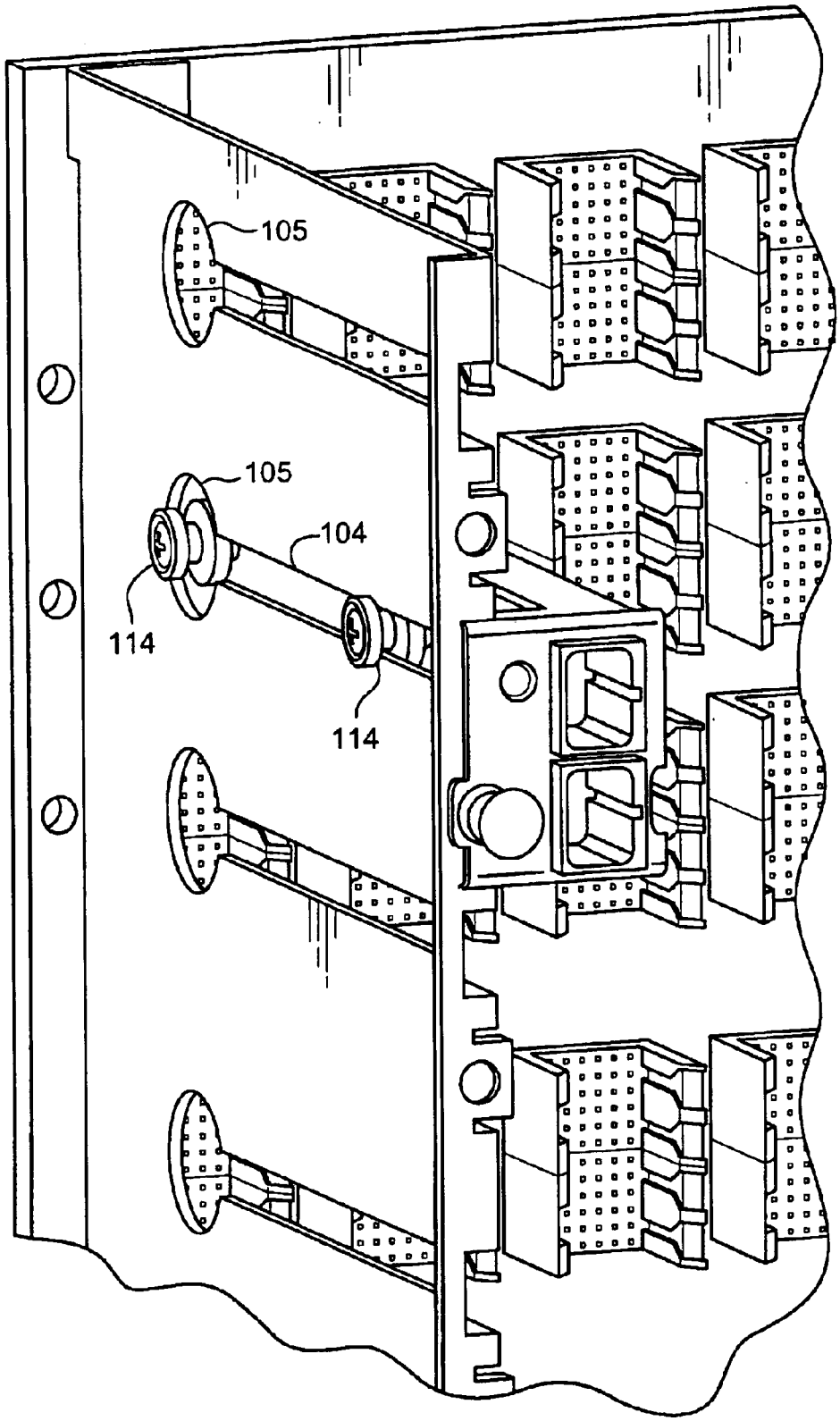
FIG. 7 illustrates further details of the view of FIG. 6.

Description of FIGS. 5, 6, and 7

FIGS. 5, 6 and 7 show the apparatus of FIG. 1 at an oblique angle which the left side of guide plate 103 is visible. This view also illustrates slots 122 on the right wall of sockets 102 which are adapted to mate with guide ribs 109 of plug 111 of FIG. 1. FIG. 5 also shows the outer axial extremity of guide posts 114 when engaged with a guide slot 104. The view of FIG. 5 is comparable to that of FIG. 3 in which the rear portion of plug 111 is proximate the outer extremity of its socket 102. FIG. 6 is similar to FIG. 5 except that it shows the circuit board assembly 110 fully inserted into its socket 102. At this time, its rear guide post 114 is within the confines of opening 105. FIG. 7 illustrates the view of FIG. 6 in further detail.

Figure 8:
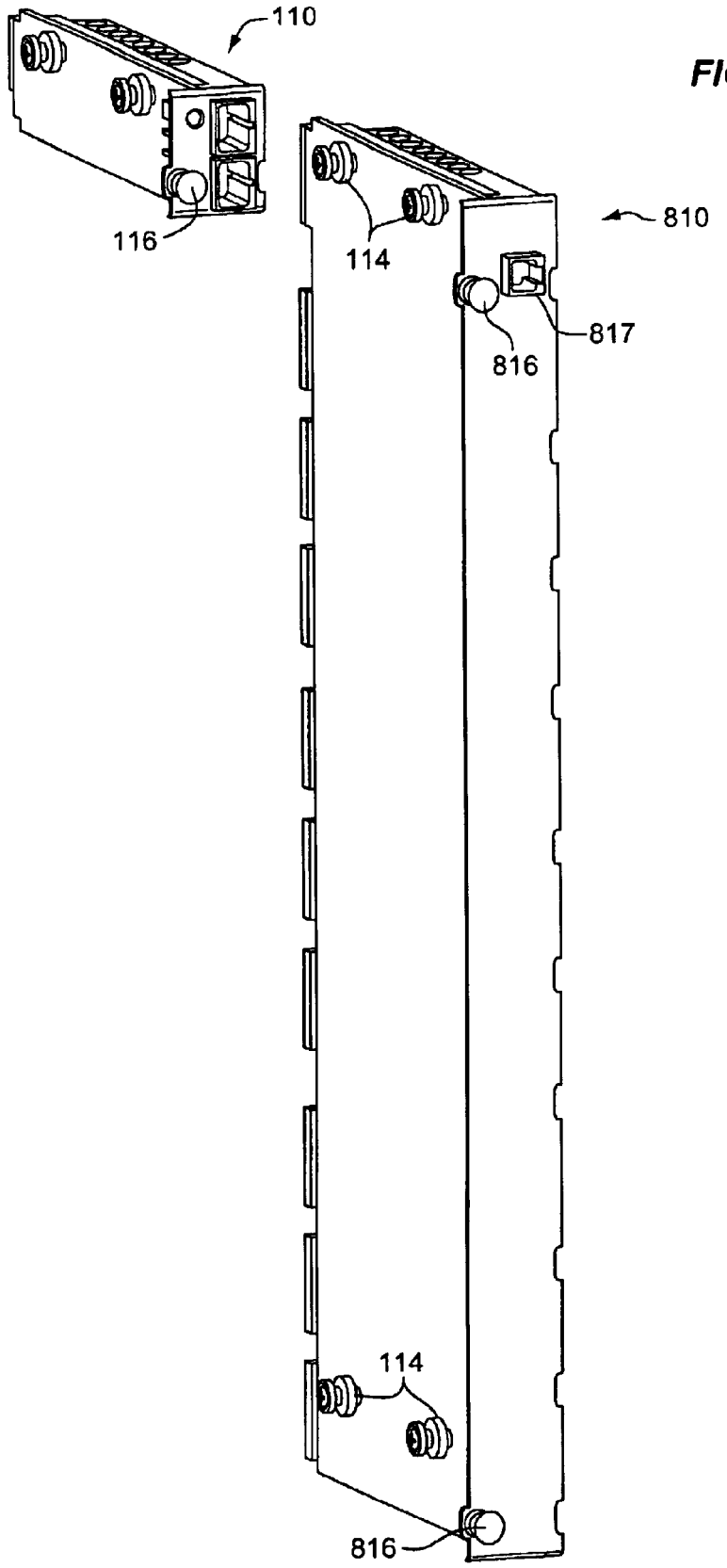
FIG. 8 illustrates two different sizes of circuit board assemblies.

Description of FIG. 8

FIG. 8 illustrates various sizes of circuit board assemblies that can be accommodated by the apparatus of the present invention. The small circuit board assembly 110 of FIG. 1 is shown in the upper left hand portion of FIG. 8. FIG. 8 also shows a larger circuit board assembly 810 which has a pair of guide posts 114 on its upper portion of the side wall and a second pair of guide posts 114 on its lower portion of its side wall. The upper pair of guide posts is adapted to engage an upper guide slot 104 of guide plate 103. The lower pair of guide post 114 is adapted to engage with a lower guide slot 104. The use of an upper and lower pair of guide posts 114 securely mounts the larger circuit board assembly to its guide plate 103. The rear portion of circuit board assembly 310 (not shown) is similar to that of circuit board assembly 110 in that it also has a plug corresponding to plug 111 of the FIG. 1 adapted to be inserted into a socket 102. Elements 816 and 817 of FIG. 8 correspond to elements 116 and 117 of FIG. 1.

Figure 9:
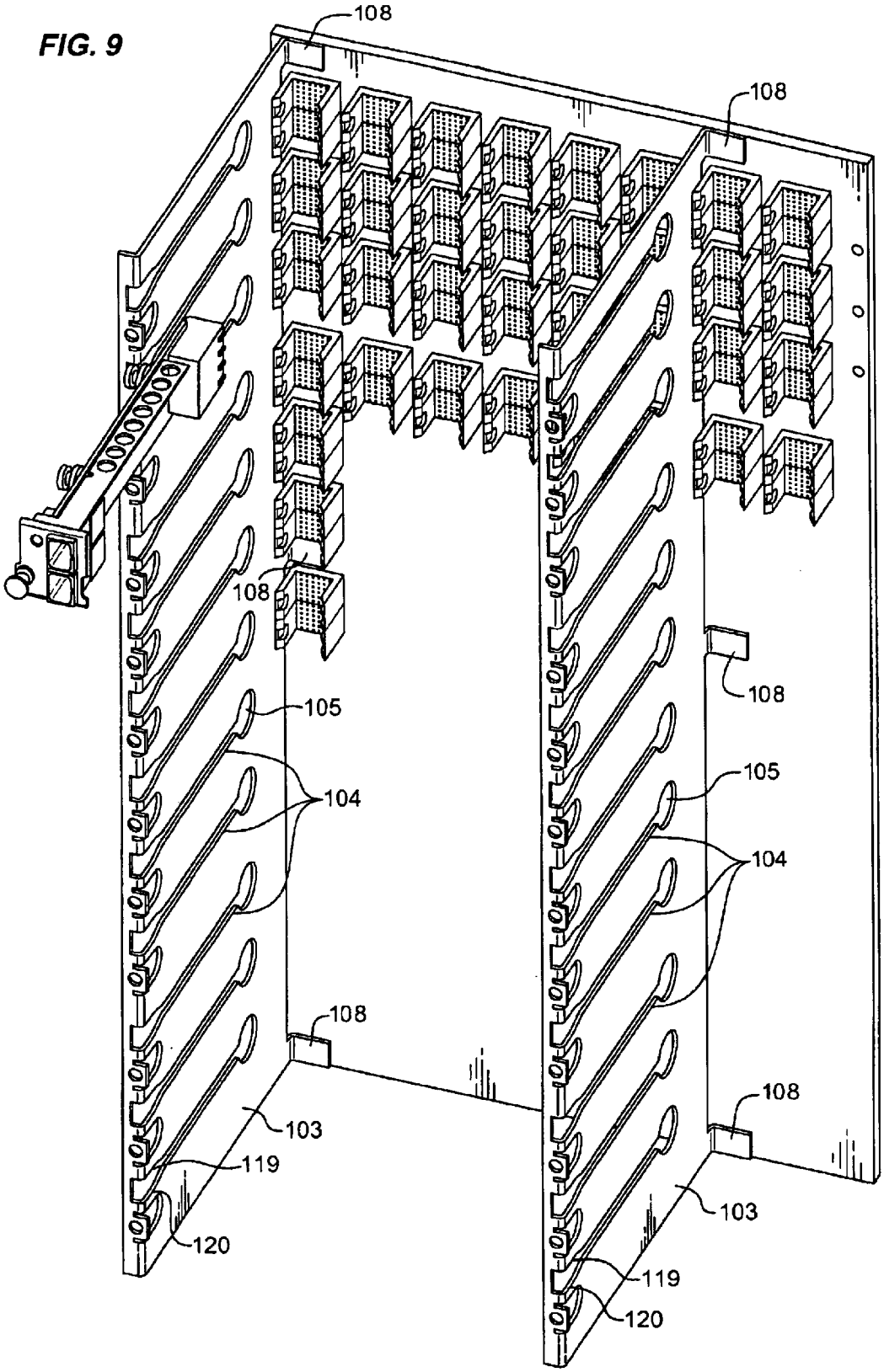
FIG. 9 is similar to the view of FIG. 1 except that it shows an additional guide plate located between a different pair of columns of backplane sockets.

Description of FIG. 9

FIG. 9 is similar to that of FIG. 1 except that it illustrates a first and a second guide plate 103 which is shown connected between the sockets of a different pair of columns. The left most guide plate 103 corresponds to that shown FIG. 1 together with its smaller circuit board assembly 110. The right most guide plate shown on FIG. 9 is similar to left most guide plate 103.

The above description provides an exemplary embodiment of this invention. It is expected that those skilled in the art can and will design alternative embodiments that infringes on this invention as set forth in the claims below either literally or through the Doctrine of Equivalents.

I claim:

1. Apparatus for controlling the guiding and alignment of circuit board assemblies with sockets of a backplane, said apparatus comprising;

a vertically oriented backplane having a plurality of sockets;

a vertical guide plate positioned perpendicular to said backplane;

a plurality of horizontal guide slots in said guide plate;

a front guide post and a rear guide post affixed to a vertical side wall of a circuit board assembly;

an open front portion of each said guide slot adapted to slidably receive said guide posts;

said guide posts and said guide slots cooperate to align and guide said circuit board assembly towards one of said sockets when said guide posts are moved from a front end portion of said guide slot towards said backplane;

a rear portion of said circuit board assembly adapted to engage one of said sockets;

a void that disengages said rear guide post from said guide slot when said circuit board assembly is moved towards said backplane to a position in which said rear portion of said circuit board assembly is proximate side walls of said one socket; and contacts on said rear portion of said circuit board assembly adapted to electrically mate with contacts on said one socket when said circuit board assembly is moved further towards said backplane so that said rear portion of said circuit board assembly fully engages said one socket.

2. The apparatus of claim 1 wherein said side walls of said one socket and side walls of said rear portion of said circuit board assembly contain protrusions and slots that are effective subsequent to said disengagement to align and control said engagement of said rear portion of said circuit board assembly into said one socket.

3. The apparatus of claim 1 in which said apparatus that disengages comprises a void positioned in said guide plate and integral with an open rear end portion of said guide slot;

said void receives said rear guide post when said rear portion of said circuit board assembly is moved to a position in which the rear portion of said circuit board assembly is proximate said one socket;

said void is of a size sufficient to enable said rear guide post to move vertically and horizontally by an amount that facilitates said engagement of said rear portion of said circuit board assembly with said one socket.

4. The apparatus of claim 1 wherein said circuit board assembly is supported by the said guide posts when said guide posts engage said guide slot.

5. The apparatus of claim 1 wherein said front end portion of said guide slot has an upwardly flared upper edge and a downwardly flared lower edge to define a vertical spacing greater than the vertical spacing defined by the remainder of said guide slot.

6. The apparatus of claim 1 wherein said sockets are arranged in a horizontal row and vertical column format on said backplane.

7. The apparatus of claim 6 wherein a plurality of guide plates are positioned between adjacent columns of said sockets;

each guide slot can receive guide posts of a different circuit board assembly.

8. The apparatus of claim 1 wherein said rear portion of said circuit board assembly is a plug;

said contacts on said plug define pins and contacts on said one socket define mating voids for electrically engaging said pins of said plug.

9. The apparatus of claim 1 wherein said rear portion of said circuit board assembly is a plug;

said contacts on said one socket define pins and contacts on said plug define mating voids for electrically engaging said pins of said one socket.

10. The apparatus of claim 1 further including:

a second circuit board assembly;

a first pair of guide posts positioned on the upper front and upper rear portion of a side wall of said second circuit board assembly;

a second pair of guide posts positioned on a lower front and lower rear portion of said side wall of said second circuit board assembly; and said first and second pair of guide posts are adapted to engage first and second guide slots of a guide plate to control the alignment of a rear portion of said second circuit board assembly with a socket of said backplane.

11. Apparatus for controlling the guiding and alignment of circuit board assemblies with sockets of a backplane, said apparatus comprising;

a vertically oriented backplane having a plurality of sockets;

a vertical guide plate positioned perpendicular to said backplane;

a plurality of horizontal guide slots in said guide plate;

a front guide post and a rear guide post affixed to a vertical side wall of a circuit board assembly;

an open front portion of each said guide slot adapted to slidably receive said guide posts;

said guide posts and said guide slots cooperate to align and guide said circuit board assembly towards one of said sockets when said guide posts are moved from a front end portion of said guide slot towards said backplane;

a plug on a rear portion of said circuit board assembly adapted to engage one of said sockets;

a void that disengages said rear guide post from said guide slot when said circuit board assembly is moved towards said backplane to a position in which said plug is proximate side walls of said one socket; and contacts on said plug adapted to electrically mate with contacts on said one socket when said circuit board assembly is moved further towards said backplane so that said plug fully engages said one socket;

said side walls of said one socket and side walls of said plug contain protrusions and slots that are effective subsequent to said disengagement to align and control the engagement of said plug into said one socket.

12. The apparatus of claim 11 wherein said sockets are arranged in a horizontal row and vertical column format on said backplane; said apparatus further comprising:

a second circuit board assembly;

a first pair of guide posts positioned on the upper front and upper rear portion of a side wall of said second circuit board assembly;

a second pair of guide posts positioned on a lower front and lower rear portion of said side wall of said second circuit board assembly;

said first and second pair of guide posts are adapted to engage first and second guide slots of a guide plate to control the alignment of said plug on the rear portion of said second circuit board assembly with a socket of said backplane.

13. A method for controlling the guiding and alignment of circuit board assemblies with sockets of a vertically oriented backplane;

a vertically oriented guide plate perpendicular to said backplane and having a plurality of horizontal guide slots;

said method comprising the steps of:

inserting a rear guide post affixed to a side wall of said circuit board assembly into a front opening of a guide slot;

moving said rear guide post of said circuit board assembly towards said backplane to a position in which a front guide post on said side wall of said circuit board assembly engages said front opening of said guide slot;

moving said circuit board assembly towards said backplane to a position in which a back surface of a plug on the rear portion of said circuit board assembly is proximate a socket adapted to engagingly receive said plug;

moving said circuit board assembly further towards said backplane to a position in which protrusions or slots on the side walls of said plug enter slots or protrusion on the side walls of said sockets; and moving said circuit board assembly further towards said backplane to a position in which contacts on the rear portion of said plug and contacts on said socket are electrically engaged.

14. A method of claim 13 comprising the further step of disengaging said rear guide post from said guide slot when the rear portion of said circuit board assembly is proximate said socket.

15. The method of claim 14 herein said step of disengaging defines a step of;

moving said circuit board assembly towards said backplane to a position in which said rear guide post disengages from a rear portion of said guide slot and enters a void integral with the rear terminus of said guide slot; and aligning said plug and said one socket under control of protrusion and slots on said side walls of said one socket and said plug that are effective subsequent to said disengagement to engage said plug with said one socket.

16. The method of claim 13 wherein said contacts on said plug and socket define pins on said plug and mating voids in said socket.

17. The method of claim 13 wherein said contacts on said plug and socket define voids on said plug and mating pins on said socket.

18. The method of claim 13 wherein sockets are arranged in a row and column format on said backplane; said method comprising the further steps of:

positioning a plurality of vertically oriented guide plates proximate said backplane with each guide plate being positioned between a different pair of columns of said sockets;

affixing guide posts to side walls of a plurality of said circuit board assemblies;

inserting said guide posts into a plurality of horizontal guide slots in said plurality of guide plates; and electrically connecting contacts on said plugs with contacts on the sockets into which said plugs are inserted by an alignment controlled by said guide posts on said circuit board assemblies and said guide slots in said guide plates.

* * * * *